US009541244B1

(12) United States Patent
Berezinski et al.

(10) Patent No.: US 9,541,244 B1
(45) Date of Patent: Jan. 10, 2017

(54) MULTI-PURPOSE PORTABLE LIGHT

(71) Applicants: Kenneth Berezinski, Fayetteville, GA (US); Nivay Sahaye, Lawrenceville, GA (US); Patrick Ryan McDowell, Peachtree City, GA (US); James Richard Christ, Peachtree City, GA (US)

(72) Inventors: Kenneth Berezinski, Fayetteville, GA (US); Nivay Sahaye, Lawrenceville, GA (US); Patrick Ryan McDowell, Peachtree City, GA (US); James Richard Christ, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 143 days.

(21) Appl. No.: 14/502,184

(22) Filed: Sep. 30, 2014

Related U.S. Application Data

(60) Provisional application No. 61/940,066, filed on Feb. 14, 2014, provisional application No. 61/913,126, filed on Dec. 6, 2013.

(51) Int. Cl.

| | |
|---|---|
| ***F21V 33/00*** | (2006.01) |
| ***F21L 4/02*** | (2006.01) |
| ***F21V 21/088*** | (2006.01) |
| ***F21V 21/096*** | (2006.01) |
| ***F21L 4/08*** | (2006.01) |
| ***F21V 21/14*** | (2006.01) |
| ***F21K 99/00*** | (2016.01) |
| *F21Y 101/02* | (2006.01) |

(52) U.S. Cl.
CPC ..... *F21L 4/022* (2013.01); *F21K 9/30* (2013.01); *F21L 4/085* (2013.01); *F21V 21/0885* (2013.01); *F21V 21/0965* (2013.01); *F21V 21/145* (2013.01); *F21V 33/0036* (2013.01); *F21Y 2101/02* (2013.01)

(58) Field of Classification Search
CPC ..... F21L 4/022; F21L 4/0085; F21V 21/0885; F21V 21/0965; F21V 33/0036; F21V 21/145; F21K 9/30; F21Y 2101/02
USPC ..... 362/109, 119, 120, 190, 202
See application file for complete search history.

(56) References Cited

U.S. PATENT DOCUMENTS

| | | | | |
|---|---|---|---|---|
| 5,988,929 | A * | 11/1999 | Doan | E02F 3/60 24/136 K |
| D418,238 | S | 12/1999 | Offiler | |
| D421,142 | S | 2/2000 | Bayat | |
| D421,143 | S | 2/2000 | Kovacik | |
| 6,027,224 | A * | 2/2000 | Schnell | B26B 11/00 362/119 |
| D441,888 | S | 5/2001 | Haneda | |

(Continued)

*Primary Examiner* — Anh Mai
*Assistant Examiner* — Glenn Zimmerman
(74) *Attorney, Agent, or Firm* — King & Spalding LLP

(57) ABSTRACT

A multi-purpose portable light includes an elongated body that has a first end and a second end. The elongated body extends from the first end to the second end. A headlight is mounted on the first end of the elongated body and a floodlight panel is located at a front portion of the elongated body. Further, the second end of the elongated body includes a base member. In addition, the elongated member includes one or more of the following elements: a belt clip, one or more magnets, an aperture to attach a fastener, a bottle opener, and a hook mechanism.

20 Claims, 7 Drawing Sheets

(56) References Cited

U.S. PATENT DOCUMENTS

| | | | | |
|---|---|---|---|---|
| 2002/0154500 | A1* | 10/2002 | Matthews | B62J 6/00 362/191 |
| 2006/0028811 | A1* | 2/2006 | Ross | F21V 33/0052 362/157 |
| 2007/0014103 | A1* | 1/2007 | Teng | F21L 4/027 362/157 |
| 2010/0085739 | A1* | 4/2010 | Webb | B26B 1/02 362/157 |
| 2010/0254122 | A1* | 10/2010 | Bayat | F21L 4/027 362/187 |
| 2011/0080736 | A1* | 4/2011 | Brands | F21L 4/027 362/277 |
| 2012/0033415 | A1* | 2/2012 | Sharrah | F21L 4/027 362/199 |
| 2012/0182727 | A1* | 7/2012 | Sharrah | F21L 4/005 362/190 |
| 2012/0275143 | A1* | 11/2012 | Robinson | F21L 4/005 362/184 |
| 2013/0100653 | A1* | 4/2013 | Renk, Jr. | F21L 4/022 362/184 |
| 2015/0036330 | A1* | 2/2015 | Economos | F21L 4/08 362/183 |

* cited by examiner

MULTI-PURPOSE PORTABLE LIGHT

CROSS REFERENCE TO RELATED APPLICATIONS

This application claims priority to U.S. Provisional Application No. 61/940,066 filed on Feb. 14, 2014 and entitled "Portable Light with Belt Clip, Bottle Opener, and Lanyard," the entire content of this provisional patent application being incorporated herein by reference. This application also claims priority to U.S. Provisional Application No. 61/913,126 filed Dec. 6, 2013 and entitled "Portable Light with Adjustable Headlight and Front Floodlight Panel."

TECHNICAL FIELD

Embodiments of the invention relate generally to electrical lighting devices, and more particularly, to a multi-purpose portable light device.

BACKGROUND

There is often a need to enhance area illumination by using portable lighting products. One such portable lighting product is a flashlight or stick light, which may be used in various settings needing light in small spaces, including, but not limited to, repair settings such as an automotive repair shop, construction settings, and other areas where no electrical outlet exists. As described above, conventional portable lighting products are limited to providing more focused and highly-intense light for small spaces and fail to provide a more general lighting such as a floodlight-like lighting feature or a combination of both general lighting and focused lighting. Further, the design of conventional portable lighting products are inefficient in that conventional portable lighting products focus primarily on providing lighting capabilities to a user, thus, leaving a majority of the surface area of the portable lighting product unused. Thus, there is a need for a technology that addresses the above-mentioned deficiencies. Conventional portable lighting products such as flashlights and stick lights can be improved by adding new features to them that offer a variety of multi-purpose functions.

SUMMARY

The present disclosure addresses the above-mentioned shortcomings with a portable light device that is designed to include multiple lighting and non-lighting features to equip the portable light device for a multi-purpose use.

In one aspect, a portable light device (herein 'portable light') includes an elongated body having a first end and a second end. The elongated body extends from the first end to the second end. A headlight is mounted on the first end of the elongated body and the second end of the elongated body includes a base member. Further, the elongated body has a front portion on which a floodlight panel is disposed. A clip assembly can be disposed on any portion of the elongated body. The clip assembly is adapted to clamp the portable light to another object.

In another aspect, a portable light includes an elongated body having a first end and a second end. The elongated body extends from the first end to the second end. A headlight is mounted on the first end of the elongated body. Further, a floodlight panel is disposed on the front portion of the elongated body, and a bottle opener can be disposed on any portion of the elongated body.

These and other aspects, features, and embodiments of the present invention may be more clearly understood and appreciated from a review of the following detailed description of the disclosed embodiments and by reference to the drawings and claims.

BRIEF DESCRIPTION OF THE FIGURES

Example embodiments are illustrated by way of example and not limitation in the figures of the accompanying drawings, in which:

FIG. 7A and FIG. 7B are collectively referred to as FIG. 7.

Figure 1:
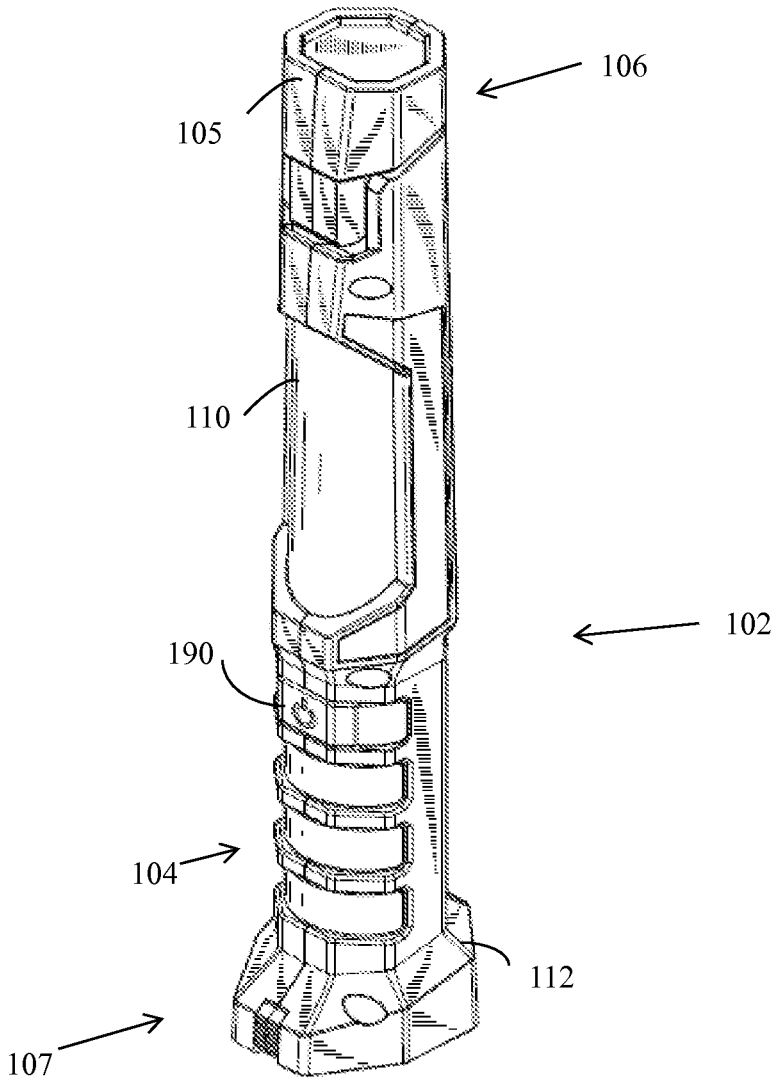
FIG. 1 is a front perspective view of a portable light in accordance with an example embodiment.

Many aspects of the example embodiments can be better understood with reference to the above drawings. The elements and features in the drawings are not to scale; emphasis is instead being placed upon clearly illustrating the principles of example embodiments. Moreover, certain dimensions may be exaggerated to help visually convey such principles. In the drawings, reference numerals designate like or corresponding, but not necessarily identical, elements throughout the several views. Other features of the example embodiments will be apparent from the Detailed Description that follows.

DETAILED DESCRIPTION OF EXAMPLE EMBODIMENTS

Example embodiments disclosed herein are directed to a multi-purpose portable light. Example embodiments are described herein with reference to the attached figures, however, these example embodiments are not limiting and those skilled in the art will appreciate that various modification are within the scope of this disclosure.

FIGS. 1-7 show various views of example embodiments of a portable light 100. The portable light 100 may include an elongated body 102 as shown in FIGS. 1-6. The elongated body 102 may be substantially cylindrical or may be shaped as a stick light. Even though FIGS. 1-6 illustrate the elongated body 102 as a substantially cylindrical shaped body, one of ordinary skill in the art can understand and appreciate that the elongated body can have any other appropriate shape, such as any geometric polyhedron shape or any non-geometric polyhedron shape. For example, the elongated body 102 may be shaped as a cuboid in some embodiments or may have a rectangular cross-section along its length.

In one example embodiment, the elongated body 102 may be designed such that a human hand can wrap around the width of the elongated body 102. In another example embodiment, the elongated body 102 may be designed to have other shapes with handle bars or similar features for gripping.

The elongated body 102 of the portable light 100 may include a surface 104 that is adapted to provide a grip to hold the portable light 100. Accordingly, the surface 104 may be ribbed to provide additional grip. In one example embodiment, the ribbed surface 104 may also be rubber coated to provide additional grip. Even though FIGS. 1-6 illustrate that the elongated body includes a ribbed surface 104, one of ordinary skill in the art can understand and appreciate that the surface 104 can be smooth without departing from a broader scope of this disclosure. In some example embodiments, the surface 104 may be tapered inwardly or outwardly from the ends of the surface 104 towards the center of the surface 104 to aid in easy handling of the portable light 100. The surface 104 may be disposed on a front portion 101 or a back portion 103 of the elongated body. Alternatively, the surface 104 may be disposed around the elongated body, i.e., both the front portion 101 and back portion 103.

Further, the elongated body may include a first end 106 and second end 107. A headlight 105 may be mounted on the first end 106 and the second end may include a base member 112. Alternatively, the first end 106 can comprise a base member 112 and the second end 107 may be mounted with the headlight 105. In one embodiment, the headlight 105 may be adjustable, whereas in another embodiment, the headlight 105 may be fixed. Hereinafter, the headlight 105 may be referred to as an adjustable headlight 105.

In one embodiment, the base member 112 may be a detachable member, whereas in another embodiment, the base member 112 may be integrated with the elongated body 102. In some embodiments, the base member 112 may be configured to be twistable to provide a tailcap twist switching mechanism for controlling lighting features of the portable light 100, for example, the adjustable headlight 105. In one example embodiment, in addition to the adjustable headlight 105, the portable light 100 includes a floodlight panel 110 that is disposed on a front portion 101 (herein interchangeably referred to as 'front side') of the elongated body 102. In another example embodiment, the floodlight panel 110 can be positioned on a back portion 103 (herein interchangeably referred to as 'back side') or any other appropriate portion of the elongated body 102, without departing from a broader scope of this disclosure. In alternate embodiments, the portable light may have only one of the adjustable headlight 105 and the floodlight panel 110. The adjustable headlight 105 can be used to provide a high intensity spot light that is more focused. In contrast, the floodlight panel 110 is designed for general area illumination or general task lighting.

In one example embodiment, the surface 104 described above may be disposed between the floodlight panel 110 and the base member 112 (herein 'base'). In another example embodiment, the surface 104 can be positioned at any other appropriate portion of the elongated body 102.

The adjustable headlight 105 is designed to pivot so that it can be directed at a variety of angles. In one application, the adjustable headlight 105 can be directed to provide light in the same general direction as the floodlight panel 110 to provide both a high intensity spot light and area illumination in the same general area. Further, in some embodiments, the adjustable headlight 105 may include a twist focus mechanism to adjust the focus of the light emanating from the adjustable headlight 105. In said embodiment, the adjustable headlight 105 may include a bezel that is circumferentially arranged around an exterior portion of the adjustable headlight 105. Said bezel can be twisted to adjust a focus of the adjustable headlight 105. Alternatively, the adjustable headlight 105 may include other automatic or mechanical based focus mechanisms.

In one example embodiment, the floodlight panel 110 and/or the adjustable headlight 105 may include an array of light emitting diodes (LEDs) or a single LED that is configured to generate appropriate light based on the respective functions of the floodlight panel 110 and/or the adjustable headlight 105. However, one of ordinary skill in the art can understand and appreciate that an LED light source can be replaced or used in combination with any other appropriate light source to achieve the functionality of the floodlight panel 110 and/or the adjustable headlight 105.

Referring to the Figures, novel features of the example portable light 100 are shown. FIGS. 2, 3, 5 and 6 show a clip assembly 115 positioned on the back side 103 of the portable light 100. In one example embodiment, the clip assembly 115 may include, but is not limited to, a belt clip. One of ordinary skill in the art can understand and appreciate that the clip assembly can include any other appropriate attaching or clamping mechanism, such as a spring clip, clamp, spring clamp, and so on. The clip assembly 115 (herein 'belt clip') can be used to clamp or attach the portable light 100 to an object, such as, a person's belt, portion of a garment, or any other appropriate surface to facilitate carrying the portable light 100. In other words, belt clip 115 can be used to attach the portable light 100 to any other appropriate structure or object on to which the belt clip 115 can fit. The belt clip 115 can be made from a variety of different materials including plastic, rubber, and a variety of metals.

As shown in FIGS. 2, 3, 5 and 6, the example belt clip 115 may be positioned near a first end 106 of the elongated body 102. In other words, the example belt clip 115 may be positioned closer to the adjustable headlight 105 than the base 112. In alternate embodiments, the example belt clip 115 can be located at other positions on the portable light or there can be more than one belt clip 115 positioned on the portable light 100 providing different options for fastening the portable light 100.

Figure 2:
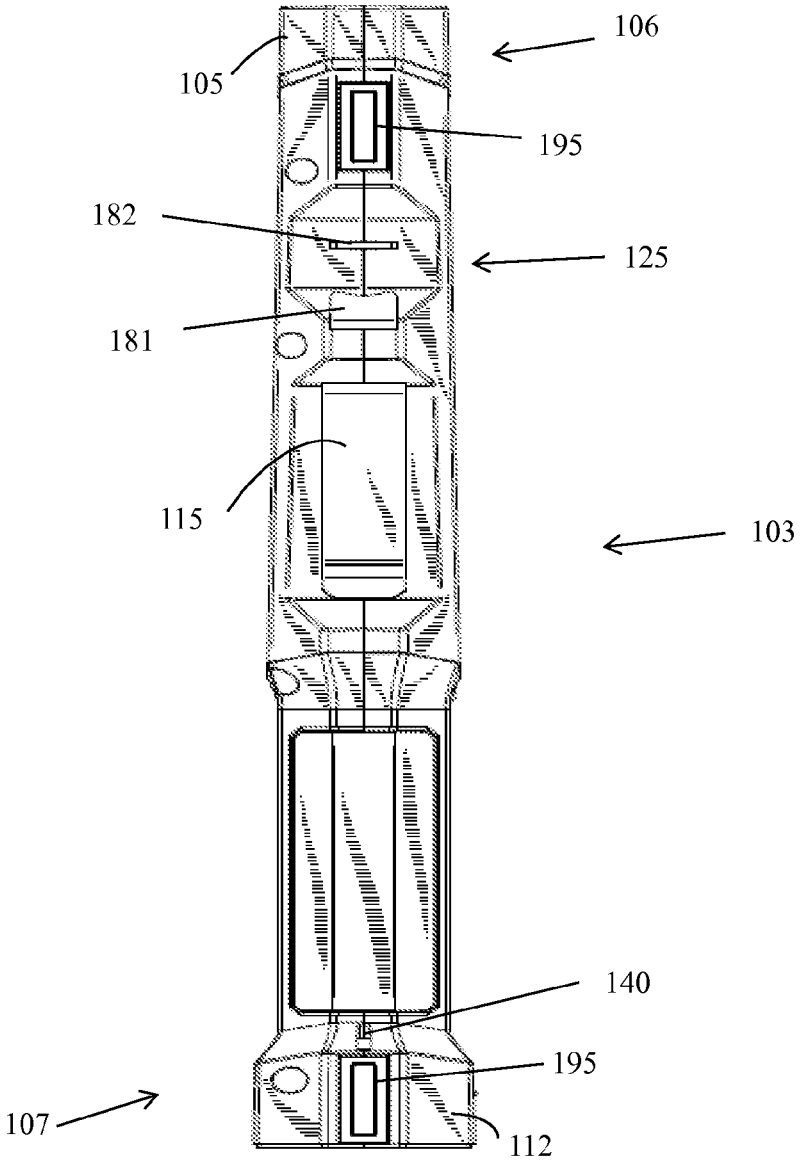
FIG. 2 is a back view of the portable light of FIG. 1 in accordance with an example embodiment.
Figure 3:
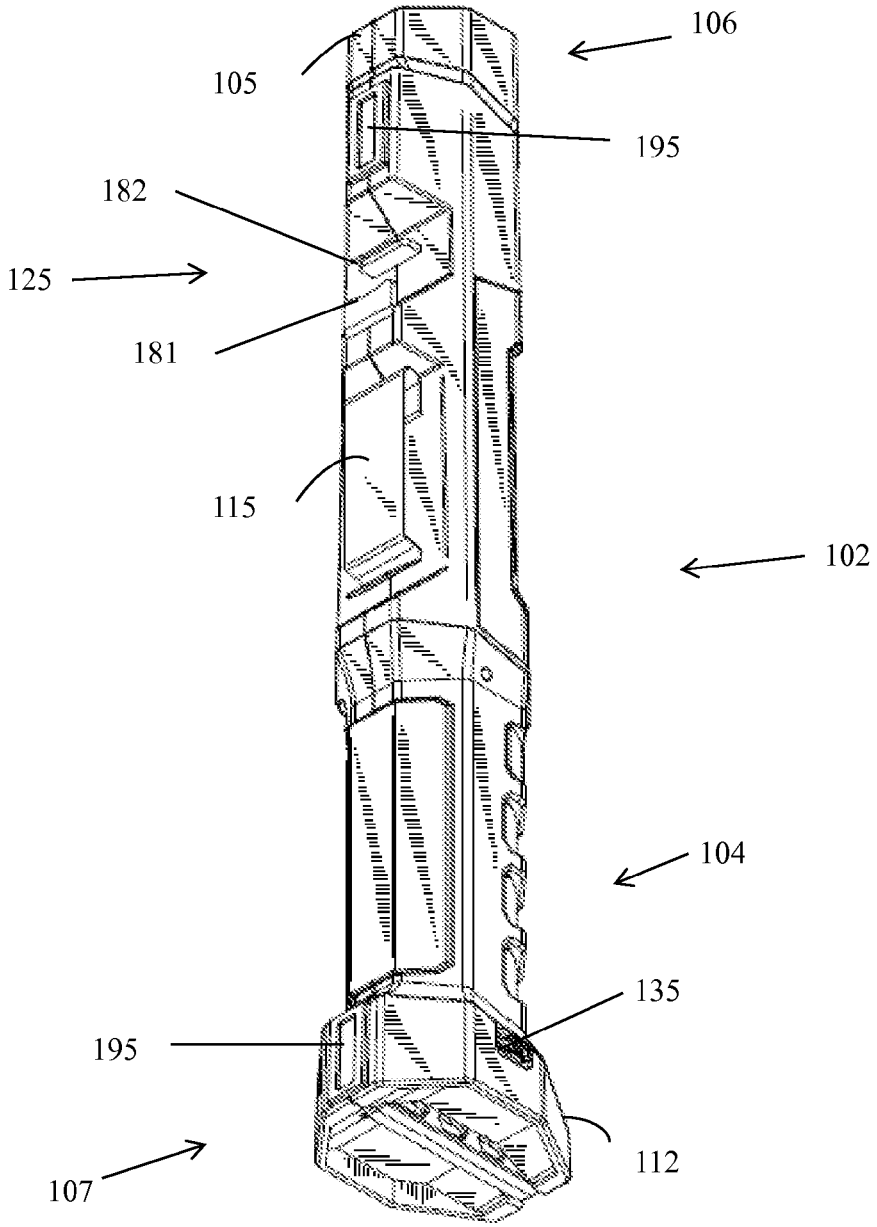
FIG. 3 is a back perspective view of the portable light of FIG. 1 in accordance with an example embodiment.

The example belt clip 115 illustrated in FIGS. 2, 3, 5 and 6 includes a body portion that has two ends. One end of the example belt clip's body portion may be attached to the portable light 100 and the body may extend towards the second end 107 of the elongated body 102. Alternatively, the body may extend towards the first end 106 of the elongated body 102. In some example embodiments, the belt clip 115 can be adapted to rotate along an axis such that the belt clip can be attached or clamped to a surface in any appropriate angle and/or orientation as desired by a user. For example, the belt clip 115 can rotate out away from the elongated body 102 of the portable light 100 or rotate about a point at which the belt clip 115 is attached to the portable light 100. An opposite end of the example belt clip 115 may include a bent portion that bends toward the portable light 100 and then away from the portable light 100 at the tip of the belt clip 115. The bent portion allows a belt or other structure to pass under the bent portion and be secured by the belt clip 115. In alternate embodiments, the belt clip 115 can take other shapes. For example, in one alternate embodiment the bent portion may only bend inward toward the portable light 100 and not bend back out away from the portable light 100 as shown in FIGS. 2 and 3. In yet another alternate embodiment, the belt clip 115 may not have any bent portion.

The example portable light 100 may include an aperture feature 140 as illustrated in FIG. 2. In one example embodiment, the aperture feature 140 may be located at the base 112 of the portable light 100. In another example embodiment, the aperture feature may be located on a side of a portable light 100. In yet another example embodiment, the aperture feature may be located at any other appropriate position around the portable light 100 to provide a variety of positions for fastening the portable light 100. As illustrated in another example aperture in FIG. 7, an aperture feature 145 of a portable light may include a pin 147 around which a fastener can be fastened. The pin 147 can be arranged in any angle within the aperture 145, such as parallel to an axis along the length of the portable light or perpendicular to the axis along the length of the portable light. One example of a fastener is a lanyard. Other examples of other fasteners include, but are not limited to, a strap, a hook, and a pin. It should be understood that multiple aperture features can be located on the portable light.

In addition to or instead of the aperture feature 140 or 145, the example portable light 100 may include two apertures on the back side 103 of the portable light 100. Alternatively, the two apertures may be located on the front side 101 of the portable light 100. The two apertures may allow for threading a fastener such as a lanyard, strap, a pin, a hook or other material (not shown in the figures) through the apertures for fastening the portable light to a structure or other object. The two apertures may be positioned on the back side 101 of the portable light 100 so that it can be fastened to a structure or object with the floodlight panel light 110 directed outward away from the structure or object to which the portable light 100 is fastened. The two apertures may be arranged such that there is one aperture on each side of the back side 101 of the portable light 100 to facilitate fastening and directing the light to the desired area of illumination. Alternate embodiments of the portable light can have more than two apertures and the apertures can be located at various positions around the portable light 100 to provide a variety of positions for fastening the portable light.

In the example portable light 100 in FIGS. 2, 3, 5 and 6, a bottle opener 125 is shown on the back side 103 of the portable light 100. In one example embodiment, the bottle opener 125 may include a recess into which at least a head of the bottle can be placed, and a flange protruding substantially along an axis that is parallel to the length of the elongated body 102 and used to pry a bottle cap off of a bottle. In another example embodiment, the bottle opener 125 may include a concave shaped recess 180 in the back side 101 of the elongated body 102, a first flange 181 protruding from one end of the concave shaped recess and substantially aligned with a longitudinal axis that runs through the longest section of the portable light 100, and a second flange 182 protruding from the concave shaped recess 180 and substantially perpendicular to the first flange 181. The first flange 181 and the second flange 182 are positioned to fit at least a head of a bottle between the first flange 181 and the second flange 182 and provide sufficient leverage to open the bottle. In some embodiments, the flanges may be retractable such that they may be hidden or partially hidden when not needed and extended when used for opening a bottle. In the example embodiment where the flanges are retractable, only the concave shaped recess 180 may be viewable externally when the flanges are hidden. In an alternate embodiment, one of the two flanges may be adjustable to accommodate a variety of bottle head sizes and shapes.

In another example embodiment, the portable light 100 may include a detachable bottle opener. In a default position, the detachable bottle opener may be attached to the elongated body 102 through a snap fit mechanism or a retractable cord mechanism. In said example embodiment, the concave shaped recess 180 can be replaced by a groove that can snap fit the detachable bottle opener such that the bottle opener is substantially flush with the surface of the elongated body. In another embodiment, said bottle opener may be hinged to the elongated body 102 at one end such that the bottle opener can swivel out when being used to pry open a bottle cap and snap fit into the groove when the bottle opener is not being used.

In the example portable light 100 shown in the Figures, the bottle opener 125 is positioned near the top of the back side of the portable light 100. In alternate embodiments, the bottle opener 125 can be located at other positions on the portable light 100. The bottle opener 125 can be made of the same material as the exterior of the portable light 100. Alternatively, the bottle opener 125 can be made of materials that are different that the exterior of the portable light.

Figure 4:
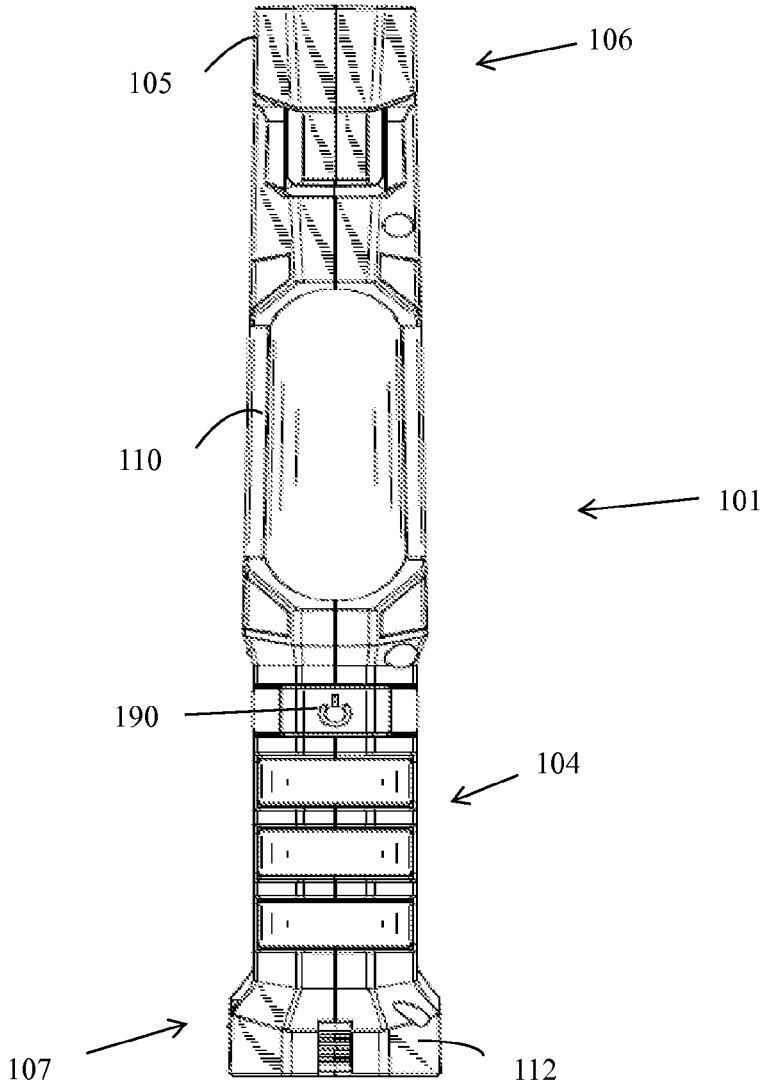
FIG. 4 is a front view of the portable light of FIG. 1 in accordance with an example embodiment.
Figure 5:
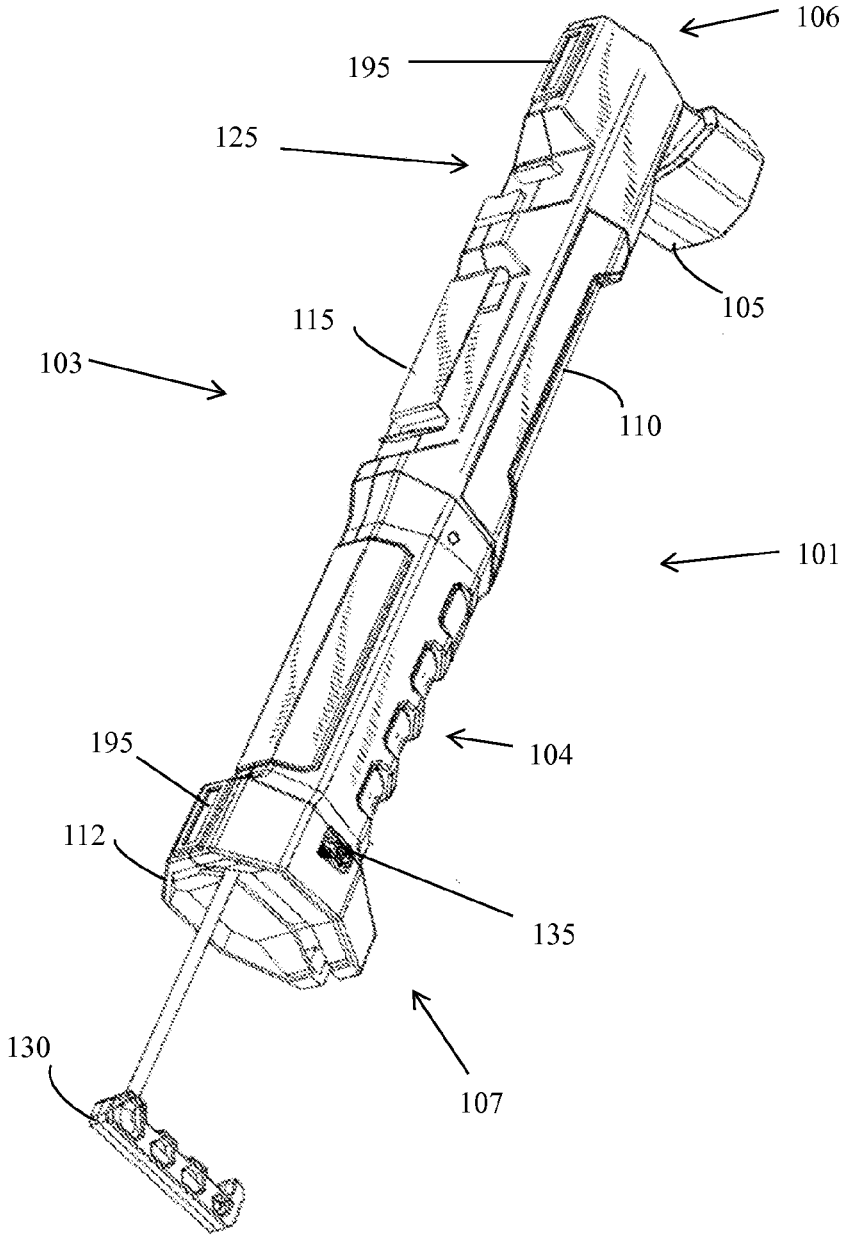
FIG. 5 is a bottom perspective view of the portable light of FIG. 1 in accordance with an example embodiment.
Figure 6:
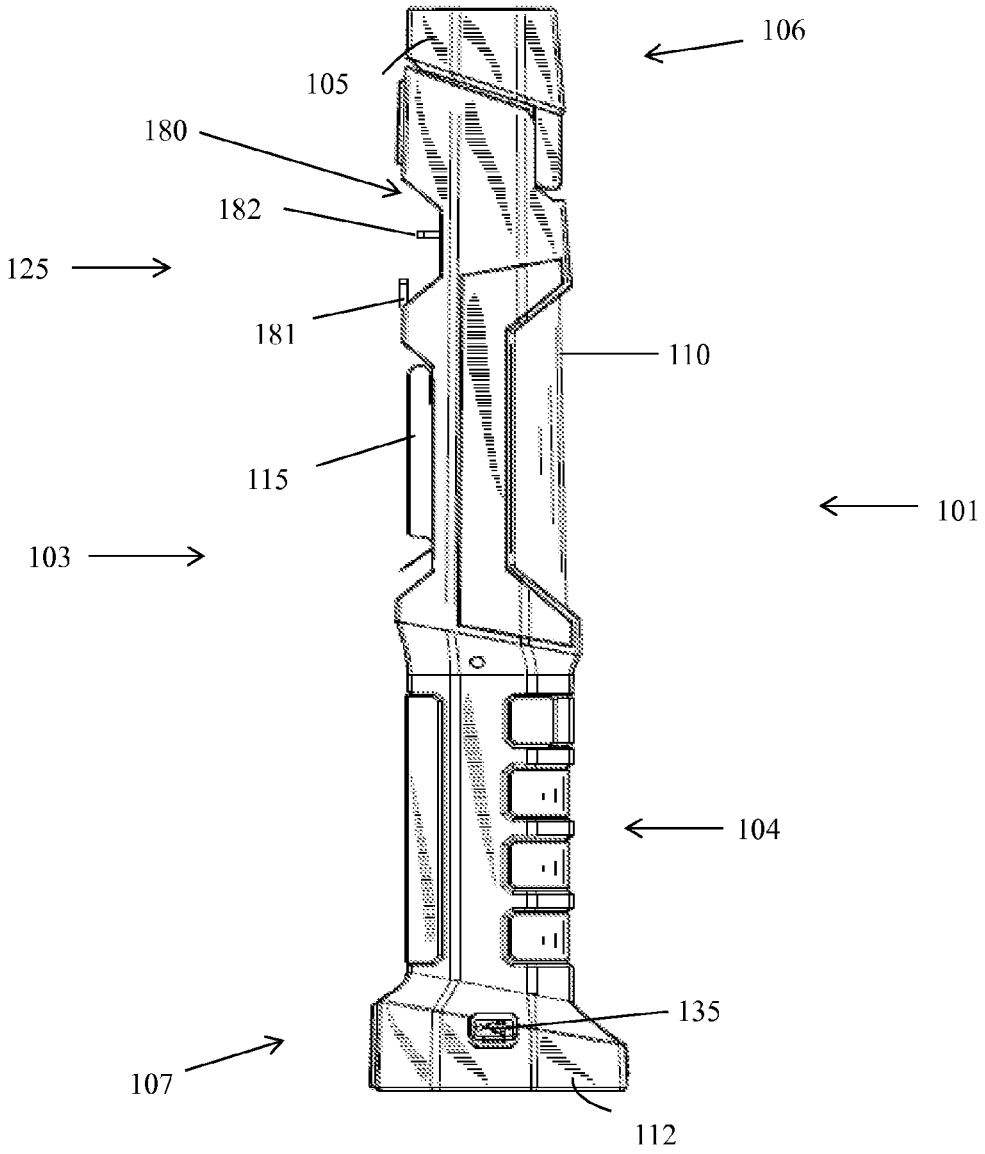
FIG. 6 is a side view of the portable light of FIG. 1 in accordance with an example embodiment.
Figure 7B:
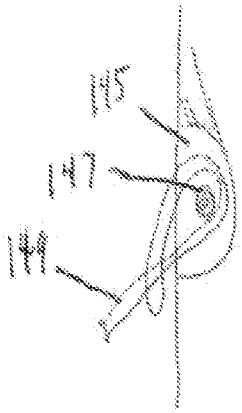
FIG. 7A is an enlarged perspective view of a portion of a portable light illustrating an aperture feature in accordance with an example embodiment and FIG. 7B is a cross-sectional view thereof.
Figure 7A:
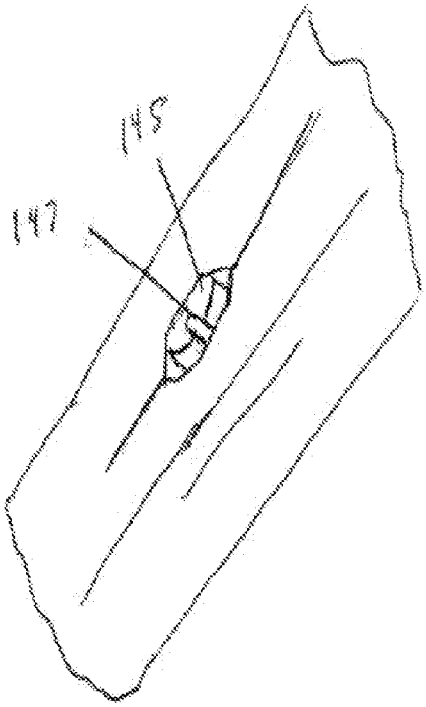

FIG. 4 shows a front view of the example portable light 100 with the floodlight panel 110. FIGS. 5 and 6 provide other views of the features of the portable light 100 described above. As illustrated in FIG. 5, the portable light 100 may include a hooking mechanism 130 located at the base 112 of the portable light 100. In one example embodiment, the hooking mechanism 130 includes a hook that can extend from the base 112 and be used to hang the portable light 100. The hook is disposed in a channel internal to the base 112. The channel internal to the base 112 may include a friction mechanism to keep the hook in place and retain an extended position when the hook is extended for hanging the portable light 100. When the hooking mechanism 130 is not in use, the hook can slide back into the channel internal to the base of the portable light 100 so that it does not interfere with use of the portable light. In some example embodiments, the hook may be rubber coated to provide friction when the hook engages a surface to which the portable light 100 is hooked.

As shown in FIGS. 1-6, the portable light 100 may include a USB port 135 for charging the portable light 100. In one embodiment, the USB port 135 may be located at the base 112 of the portable light 100. However, one of ordinary skill in the art can understand and appreciate that the USB port 135 can be located at any other portion around the elongated body of the portable light 100. Further, one of ordinary skill in the art can understand and appreciate that the USB port can be replaced with any other appropriate charging ports such as a mini USB port, an AC charging port, and so on without departing from a broader scope of this disclosure. Alternatively, another charging port that supports a different charging mechanism other than USB charging may be provided in addition to the USB port 135. In some example embodiments, the portable light may be battery operated.

Further, as illustrated in FIGS. 1-6, the portable light 100 may include a pair of magnets 195 disposed on the back side 103 of the portable light 100 that allows for easy mounting of the portable light. Alternatively, one or more magnets 195 can be located at any other portion of the portable light to provide various mounting positions.

In addition, as illustrated in FIGS. 1-6, the portable light 100 may include a power switch 190 that is configured to control the adjustable headlight 105 and/or the floodlight panel light 110. The power switch 190 can include, but is not limited to, a side click button or switch, a tailcap click switch, a membrane press switch/button, a side slide switch, a magnetic reed switch, and so on. In some example embodiments, the power switch 190 may be replaced by a bezel twist switching mechanism or a tailcap twist switching mechanism. The example power switch 190 as illustrated in FIGS. 1-6 may be disposed on a front side 101 of the elongated body 102. However, one of ordinary skill in the art can understand that the power button can be positioned at any other appropriate portion of the elongated body, without departing from a broader scope of this disclosure.

In one example embodiments, the portable light 100 may include touch based mechanism for controlling the adjustable light 105, the floodlight panel 110, and/or other features of the portable light 100. In another example embodiment, the portable light 100 may include a fingerprint scanning or biometric scanning mechanism for activating or controlling one or more features of the portable light 100. In some example embodiments, the portable light 100 may include a display mechanism (indicator LED's) or a display panel with text display disposed on any appropriate portion of the portable light 100 to indicate the status of various features of the portable light, such as if the portable light is fully charged, the lights needs to be replaced, a direction such as a compass feature, a temperature, etc. The display panel may be activated by touch or other switch mechanisms, and the display panel is activated only as needed to preserve power. When not being used, the display panel may be switched off or in a sleep mode. In an alternate embodiment, the display panel or mechanism may remain switched on at all times.

Although the disclosure refers to example embodiments, it should be appreciated by those skilled in the art that various modifications are well within the scope of the disclosure. From the foregoing, it will be appreciated that an embodiment of the disclosure overcomes the limitations of the prior art. Those skilled in the art will appreciate that the disclosure is not limited to any specifically discussed application and that the embodiments described herein are illustrative and not restrictive. From the description of the example embodiments, equivalents of the elements shown therein will suggest themselves to those skilled in the art, and ways of constructing other embodiments of this disclosure will suggest themselves to practitioners of the art. Therefore, the scope of this disclosure is not limited herein.

What is claimed is:

1. A portable light, comprising:

an elongated body having a first end and a second end and extending between the first end and the second end, wherein the first end is opposite to the second end;

the second end of the elongated body comprising a base member;

a floodlight panel disposed on a front portion of the elongated body and configured to illuminate an area in a first direction;

a headlight pivotally mounted on the first end of the elongated body, wherein the headlight is adjustable such that it pivots between a default position facing a second direction and a pivoted position facing the first direction, wherein the second direction is different from the first direction, and wherein in the pivoted position the headlight is configured to illuminate the area in the first direction; and a clip assembly disposed along the elongated body and adapted to clamp the portable light to another object.

2. The portable light of claim 1, wherein the clip assembly is a belt clip.

3. The portable light of claim 1, wherein the clip assembly is positioned near the first end of the elongated body and extends towards the second end.

4. The portable light of claim 1, further comprising: one or more magnets disposed along the elongated body to mount the portable light to a magnetic surface.

5. The portable light of claim 1, further comprising: a bottle opener disposed along the elongated body.

6. The portable light of claim 1, wherein the base member comprises a USB port for charging the portable light.

7. The portable light of claim 1, wherein the base member comprises a hook that is movable and is disposed in a channel internal to the base member.

8. The portable light of claim 1, wherein the base member comprises an aperture and a pin within the aperture for coupling a fastener.

9. The portable light of claim 1, further comprising: a power button disposed on the front portion of the elongated body to control at least one of the floodlight panel and the headlight.

10. The portable light of claim 1, further comprising: a ribbed surface disposed on the front portion of the elongated body between the floodlight panel and the base member to provide a grip to hold the portable light, wherein the ribbed surface is rubber coated.

11. The portable light of claim 1, wherein the floodlight panel comprises an array of light emitting diodes (LEDs).

12. The portable light of claim 2, wherein the belt clip comprises a body and one or more bent portions that forms a hook shaped feature.

13. The portable light of claim 7, wherein the channel internal to the base member includes a friction mechanism to keep the hook in place.

14. The portable light of claim 13, wherein the hook comprises a wire coated with rubber material, wherein the rubber coating provides friction when the hook engages a surface.

15. A portable light, comprising:

an elongated body having a first end and a second end and extending between the first end and the second end, wherein the first end is opposite to the second end, and wherein the elongated body comprises an aperture and a pin within the aperture for coupling a fastener;

a headlight mounted on the first end of the elongated body;

a floodlight panel disposed on a front portion of the elongated body; and a bottle opener disposed along the elongated body.

16. The portable light of claim 15, wherein the bottle opener comprises:

a concave shaped recess disposed along the elongated body;

a first flange protruding from one end of the concave shaped recess along the plane of the elongated body; and a second flange protruding from the concave shaped recess along the axis that is perpendicular to a plane of the elongated body, wherein the first flange and the second flange are positioned to fit at least a head of a bottle between the first flange and the second flange and provide sufficient leverage to open the bottle.

17. The portable light of claim 15, further comprising:

a clip assembly disposed along the elongated body and positioned near the first end of the elongated body, wherein the clip assembly is adapted to clamp the portable light to another object;

a power button disposed on the front portion of the elongated body; and a ribbed surface disposed on the front portion of the elongated body between the floodlight panel and the second end to provide a grip to hold the portable light.

18. The portable light of claim 15:

wherein the elongated body comprises a USB port for charging the portable light.

19. The portable light of claim 15, wherein the second end comprises a hook that is extendable.

20. A portable light, comprising:

an elongated body having a first end and a second end and extending between the first end and the second end, wherein the first end is opposite to the second end;

the second end of the elongated body comprising a base member, wherein the base member comprises a hook that is movable and is disposed in a channel internal to the base member, and wherein the channel internal to the base member includes a friction mechanism to keep the hook in place;

a headlight mounted on the first end of the elongated body; and a floodlight panel disposed on a front portion of the elongated body.

* * * * *